US010950164B2

(12) United States Patent
Gao et al.

(10) Patent No.: US 10,950,164 B2
(45) Date of Patent: Mar. 16, 2021

(54) METHOD AND DEVICE FOR DETERMINING COMPENSATION GRAYSCALE VALUE OF DISPLAY PANEL, AND DISPLAY DEVICE

(71) Applicant: WuHan TianMa Micro-Electronics Co., Ltd., Wuhan (CN)

(72) Inventors: Xiangyu Gao, Wuhan (CN); Jingxiong Zhou, Wuhan (CN); Zhenyuan Zhang, Wuhan (CN); Guang Wang, Wuhan (CN)

(73) Assignee: WuHan TianMa Micro-Electronics Co., Ltd., Wuhan (CN)

( * ) Notice: Subject to any disclaimer, the term of this patent is extended or adjusted under 35 U.S.C. 154(b) by 0 days.

(21) Appl. No.: 16/455,755

(22) Filed: Jun. 28, 2019

(65) Prior Publication Data

US 2019/0318680 A1 Oct. 17, 2019

(30) Foreign Application Priority Data

Jan. 31, 2019 (CN) ..... 201910100626.2

(51) Int. Cl.
*G09G 3/20* (2006.01)
*G09G 3/36* (2006.01)

(52) U.S. Cl.
CPC ... *G09G 3/2074* (2013.01); *G09G 2320/0271* (2013.01); *G09G 2320/0285* (2013.01)

(58) Field of Classification Search
CPC ..... G09G 3/2074; G09G 3/3607
See application file for complete search history.

(56) References Cited

U.S. PATENT DOCUMENTS

2010/0141673 A1* 6/2010 Gerade ..... G09G 5/10 345/589
2015/0194107 A1* 7/2015 Bae ..... G09G 3/3688 345/696
2016/0049123 A1* 2/2016 Jeong ..... G09G 3/3607 345/690
2017/0243562 A1* 8/2017 Hu ..... G09G 5/10
2018/0182321 A1* 6/2018 Zeng ..... G09G 3/3614
2018/0218693 A1* 8/2018 Zhang ..... G09G 3/3685

FOREIGN PATENT DOCUMENTS

CN 105700847 A 6/2016
CN 107294538 A 10/2017
CN 107799065 A 3/2018

* cited by examiner

*Primary Examiner* — Yi Yang
(74) *Attorney, Agent, or Firm* — Kilpatrick Townsend & Stockton, LLP

(57) ABSTRACT

Provided is a method for determining a compensation grayscale value of a display panel. The method includes searching, in a table of grayscale bit number judgment values, for a grayscale bit number judgment value corresponding to a sub-pixel to be compensated; determining a compensation grayscale value corresponding to the sub-pixel to be compensated by a first reading process if the grayscale bit number judgment value satisfies a grayscale bit number condition, and determining the compensation grayscale value corresponding to the sub-pixel to be compensated by a second reading process if the grayscale bit number judgment value does not satisfy the grayscale bit number condition.

10 Claims, 3 Drawing Sheets

METHOD AND DEVICE FOR DETERMINING COMPENSATION GRAYSCALE VALUE OF DISPLAY PANEL, AND DISPLAY DEVICE

CROSS-REFERENCE TO RELATED APPLICATIONS

The present disclosure claims priority to Chinese Patent Application No. 201910100626.2, filed on Jan. 31, 2019, the content of which is incorporated herein by reference in its entirety.

FIELD

The present disclosure relates to the field of display technologies, and in particular, to a method and a device for determining a compensation grayscale value of a display panel, and a display device.

BACKGROUND

At present, after being manufactured, a display panel usually needs to be optically detected first. Then, a compensation grayscale value is set for each sub-pixel in accordance with the optical detection result, and the preset compensation grayscale value is stored in a memory. Thereafter, when the display panel operates normally, a compensation grayscale value corresponding to each sub-pixel is read from the memory, and original grayscale data of the sub-pixel is compensated in accordance with the compensation grayscale value. Then, the sub-pixel is driven in accordance with the compensated grayscale data. In this way, an image can be displayed in an improved effect by means of the grayscale value compensation.

However, the existing method for storing the compensation grayscale value requires a large storage space, and thus the production cost is relatively high.

SUMMARY

The present disclosure provides a method and a device for determining a compensation grayscale value of a display panel, and a display device, which can reduce space for storing data related to the compensation grayscale value, thereby reducing the cost.

One embodiment of the present disclosure provides a method for determining a compensation grayscale value of a display panel, including: searching, in a table of grayscale bit number judgment values, for a grayscale bit number judgment value corresponding to a sub-pixel to be compensated; determining a compensation grayscale value corresponding to the sub-pixel to be compensated by a first reading process if the grayscale bit number judgment value satisfies a grayscale bit number condition; and determining the compensation grayscale value corresponding to the sub-pixel to be compensated by a second reading process if the grayscale bit number judgment value does not satisfy the grayscale bit number condition. The first reading process includes: searching, in a table of first compensation grayscale values, for a first grayscale value position corresponding to the sub-pixel to be compensated, and determining the compensation grayscale value corresponding to the sub-pixel to be compensated in accordance with data at the first grayscale value position. The second reading process includes: searching, in the table of first compensation grayscale values, for the first grayscale value position corresponding to the sub-pixel to be compensated; searching, in a table of second compensation grayscale values, for a second grayscale value position corresponding to the sub-pixel to be compensated; and determining the compensation grayscale value corresponding to the sub-pixel to be compensated in accordance with the data at the first grayscale value position and data at the second grayscale value position.

One embodiment of the present disclosure provides a device for determining a compensation grayscale value of a display panel, including: a first searching device configured to search, in a table of grayscale bit number judgment values, for a grayscale bit number judgment value corresponding to a sub-pixel to be compensated; and a compensation grayscale value determining device configured to determine a compensation grayscale value corresponding to the sub-pixel to be compensated by a first reading process if the grayscale bit number judgment value satisfies a grayscale bit number condition, and to determine the compensation grayscale value corresponding to the sub-pixel to be compensated by a second reading process if the grayscale bit number judgment value does not satisfy the grayscale bit number condition. The first reading process includes: searching, in a table of first compensation grayscale values, for a first grayscale value position corresponding to the sub-pixel to be compensated, and determining the compensation grayscale value corresponding to the sub-pixel to be compensated in accordance with data at the first grayscale value position. The second reading process includes: searching, in the table of first compensation grayscale values, for the first grayscale value position corresponding to the sub-pixel to be compensated; searching, in a table of second compensation grayscale values, for a second grayscale value position corresponding to the sub-pixel to be compensated; and determining the compensation grayscale value corresponding to the sub-pixel to be compensated in accordance with the data at the first grayscale value position and data at the second grayscale value position.

In one embodiment of the present disclosure provides a display device, including a memory configured to store information including program instructions and a processor configured to control execution of the program instructions. The e program instructions are loaded and executed by the processor to implement the method for determining the compensation grayscale value of the display panel according to the previous embodiments.

BRIEF DESCRIPTION OF DRAWINGS

In order to more clearly illustrate embodiments of the present disclosure, the accompanying drawings used in the embodiments and in the related art are briefly introduced as follows. It should be noted that the drawings described as follows are merely part of the embodiments of the present disclosure.

DESCRIPTION OF EMBODIMENTS

Embodiments of the present disclosure are described in the following with reference to the accompanying drawings. It should be understood that the described embodiments are merely exemplary embodiments of the present disclosure, which shall not be interpreted as providing limitations to the present disclosure.

The terms used in the embodiments of the present disclosure are merely for the purpose of describing particular embodiments but not intended to limit the present disclosure. Unless otherwise noted in the context, the singular form expressions "a", "an", "the" and "said" used in the embodiments and appended claims of the present disclosure are also intended to represent plural form expressions thereof.

In order to further illustrate beneficial effects of embodiments of the present disclosure, the related art is described before describing the embodiments of the present disclosure. In the related art, data is stored in binary, and each sub-pixel occupies a space of 8 bits for storing a corresponding compensation grayscale value. Here, bit8 is a sign bit, and bit1-bit7 are value bits. For example, if the compensation grayscale value is a positive value, bit8=1, and otherwise, bit8=0. For example, if the compensation grayscale value is +2, the corresponding data is 10000010, and if the compensation grayscale value is −2, the corresponding data is 00000010. If no compensation is performed, that is, the compensation grayscale value is 0, the corresponding data is 00000000.

A method for reading the compensation grayscale value in the related art will be described in the following by taking five sub-pixels as an example. Table 1 is a table that illustrates compensation grayscale values corresponding to five sub-pixels in the related art.

TABLE 1

| | sub-pixel A1 | sub-pixel A2 | sub-pixel A3 | sub-pixel A4 | sub-p ixel A5 |
|---|---|---|---|---|---|
| compensation grayscale value | 1 | 25 | 0 | −25 | −1 |
| stored data | 1000001 | 10011001 | 00000000 | 00011001 | 00000001 |

Each sub-pixel corresponds to a space of 8 bits, i.e., a grid of the table. The space of 8 bits corresponding to each sub-pixel is read, thereby obtaining the compensation grayscale value corresponding to this sub-pixel. It can be seen that in the related art, regardless of the value, a largest storage space is required for storing the data, thus causing waste of storage space.

Figure 1:
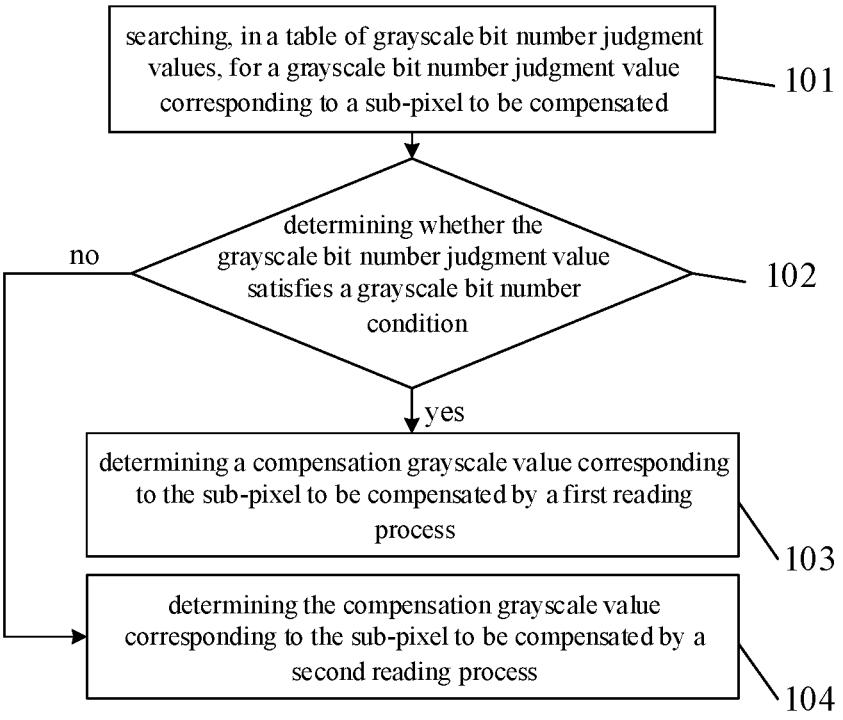
FIG. 1 is a schematic flowchart of a method for determining a compensation grayscale value of a display panel according to an embodiment of the present disclosure.

FIG. 1 is a schematic flowchart of a method for determining a compensation grayscale value of a display panel according to an embodiment of the present disclosure. As shown in FIG. 1, an embodiment of the present disclosure provides a method for determining a compensation grayscale value of a display panel, and the method includes following steps.

At step 101, a search is performed in a table of grayscale bit number judgment values for a grayscale bit number judgment value corresponding to a sub-pixel to be compensated.

For example, Table 2 is a table that illustrates compensation grayscale values corresponding to 5 sub-pixels in an embodiment of the present disclosure. A second row illustrates decimal compensation grayscale values corresponding to each sub-pixel. A third row illustrates binary compensation grayscale values corresponding to each sub-pixel, and the third row is a table of grayscale bit number judgment values and corresponds to data on a grayscale bit number judgment value corresponding to each sub-pixel. A fourth row is a table of first compensation grayscale values and illustrates data on a first compensation grayscale value corresponding to each sub-pixel, and the data on the first compensation grayscale value corresponding to each sub-pixel occupies a space of 4 bits. Herein, if a sub-pixel corresponds to a binary compensation grayscale value having more than 4 bits, that is, if a sub-pixel corresponds to a decimal compensation grayscale value having an absolute value greater than 7, this sub-pixel further corresponds to data on a second compensation grayscale value listed in a table of second compensation grayscale values represented by a fifth row. The data on a second compensation grayscale value corresponding to each sub-pixel occupies a space of 2 bits. In the table of grayscale bit number judgment values, the grayscale bit number judgment value corresponding to each sub-pixel is 0 or 1 and is used to indicate whether the binary grayscale bit number corresponding to the sub-pixel is greater than 4. If the binary grayscale bit number corresponding to a sub-pixel is greater than 4, the grayscale bit number judgment value corresponding to this sub-pixel is 1. If the binary grayscale bit number corresponding to a sub-pixel is not greater than 4, the grayscale bit number judgment value corresponding to this sub-pixel is 0. The data in the table of grayscale bit number judgment values, the table of first compensation grayscale values and the table of second compensation grayscale values is pre-stored in the memory. If a grayscale bit number of a binary compensation grayscale value corresponding to a sub-pixel is not greater than 4, the binary compensation grayscale value corresponding to this sub-pixel is the corresponding data in the table of first compensation grayscale values. If a grayscale bit number of a binary compensation grayscale value corresponding to a sub-pixel is greater than 4, the binary compensation grayscale value corresponding to this sub-pixel is obtained by combining data in the table of first compensation grayscale values with data in the table of second compensation grayscale values. In an example, the data in the table of first compensation grayscale values is highest 4 bits-data and bit4 is a sign bit, and the data in the table of second compensation grayscale values is lowest 2 bits-data. For example, a first compensation grayscale value 1110 corresponding to a sub-pixel A2 is combined with a second compensation grayscale value 01 corresponding to the sub-pixel A2, so as to obtain a binary compensation grayscale value 111001, that is, the decimal compensation grayscale value is 25.

TABLE 2

| | Sub-pixel A1 | Sub-pixel A2 | Sub-pixel A3 | Sub-pixel A4 | Sub-pixel A5 |
|---|---|---|---|---|---|
| Decimal compensation grayscale value | 1 | 25 | 0 | −25 | −1 |
| Binary compensation grayscale value | 1001 | 111001 | 0000 | 011001 | 0001 |
| Table of grayscale bit number judgment values | 0 | 1 | 0 | 1 | 0 |
| Table of first | 1001 | 1110 | 0000 | 0110 | 0001 |

TABLE 2-continued

| | Sub-pixel A1 | Sub-pixel A2 | Sub-pixel A3 | Sub-pixel A4 | Sub-pixel A5 |
|---|---|---|---|---|---|
| compensation grayscale values | | | | | |
| Table of second compensation grayscale values | | 01 | | 01 | |

At step 102, it is determined whether the grayscale bit number judgment value satisfies a grayscale bit number condition, if the grayscale bit number judgment value satisfies the grayscale bit number condition, the method proceeds to step 103. At step 103, a compensation grayscale value corresponding to the sub-pixel to be compensated is determined by a first reading process. If the grayscale bit number judgment value does not satisfy the grayscale bit number condition, the method proceeds to step 104. At step 104, the compensation grayscale value corresponding to the sub-pixel to be compensated is determined by a second reading process.

For example, as shown in Table 2, the grayscale bit number judgment value being 0 indicates that the grayscale bit number condition is satisfied, and the grayscale bit number judgment value being 1 indicates that the grayscale bit number condition is not satisfied.

At step 103, the first reading process includes: searching, in the table of first compensation grayscale values, for a first grayscale value position corresponding to the sub-pixel to be compensated, and determining the compensation grayscale value corresponding to the sub-pixel to be compensated in accordance with data at the first grayscale value position.

At step 104, the second reading process includes: searching, in the table of first compensation grayscale values, for a first grayscale value position corresponding to the sub-pixel to be compensated; searching, in the table of second compensation grayscale values, for a second grayscale value position corresponding to the sub-pixel to be compensated; and determining the compensation grayscale value corresponding to the sub-pixel to be compensated in accordance with the data at the first grayscale value position and data at the second grayscale value position.

In an example, as shown in Table 2, the table of grayscale bit number judgment values, the table of first compensation grayscale values and the table of second compensation grayscale values are pre-stored in the memory. When the display panel is in an operation, a sub-pixel A1 is taken as the sub-pixel to be compensated, and step 101 is performed to search, in the table of grayscale bit number judgment values, for the grayscale bit number judgment value corresponding to the sub-pixel A1. At step 102, it is determined that the grayscale bit number judgment value corresponding to the sub-pixel A1 is 0, which satisfies the grayscale bit number condition, and thus the method proceeds to step 103. At step 103, a search is performed in the table of first compensation grayscale values for a first grayscale value position corresponding to the sub-pixel A1, and data at the first grayscale value position is 1001, which is then used as the compensation grayscale value corresponding to the sub-pixel A1 for performing compensation to the sub-pixel A1. Then, a sub-pixel A2 is taken as the sub-pixel to be compensated, and step 101 is performed to search, in the table of grayscale bit number judgment values, for the grayscale bit number judgment value corresponding to the sub-pixel A2. At step 102, it is determined that the grayscale bit number judgment value corresponding to the sub-pixel A2 is 1, which does not satisfy the grayscale bit number condition, and thus the method proceeds to step 104. At step 104, a search is performed in the table of first compensation grayscale values for a first grayscale value position corresponding to the sub-pixel A2 and a search is performed in the table of second compensation grayscale values for a second grayscale value position corresponding to the sub-pixel A2, and the data at the first grayscale value position is 1110 and the data at the second grayscale value position is 01. Then, 1110 is used as the highest 4 bits and 01 is used as the lowest 2 bits, so as to obtain 111001 as the compensation grayscale value corresponding to the sub-pixel A2. By this analogy, the compensation grayscale value corresponding to each sub-pixel is determined, and the grayscale compensation is performed in accordance with the respective compensation grayscale value. It can be seen by comparing Table 1 with Table 2 that data on the compensation grayscale value corresponding to each sub-pixel occupies a space of 8 bits in the related art, while according to the embodiments of the present disclosure, the data on the compensation grayscale value is stored based on classification of the number of bits of the compensation grayscale value. For example, a sub-pixel corresponding to a decimal compensation grayscale value having an absolute value not greater than 7 requires only a space of 5 bits, including 1 bit occupied by the grayscale bit number judgment value and 4 bits occupied by the first compensation grayscale value, and a sub-pixel corresponding to a decimal compensation grayscale value having an absolute value greater than 7 requires only 7 bits, including 1 bit occupied by the grayscale bit number judgment value, 4 bits occupied by the first compensation grayscale value and 2 bits occupied by the second compensation grayscale value.

With the method for determining the compensation grayscale value of the display panel in the embodiments of the present disclosure, redundant data can be reduced by means of classification storage. Moreover, since a probability that one grayscale value to be actually compensated in the display panel has a large bit number is low, classification depending on the bit number of the grayscale value can further reduce space for storing data related to the compensation grayscale value, thereby reducing the cost.

Figure 2:
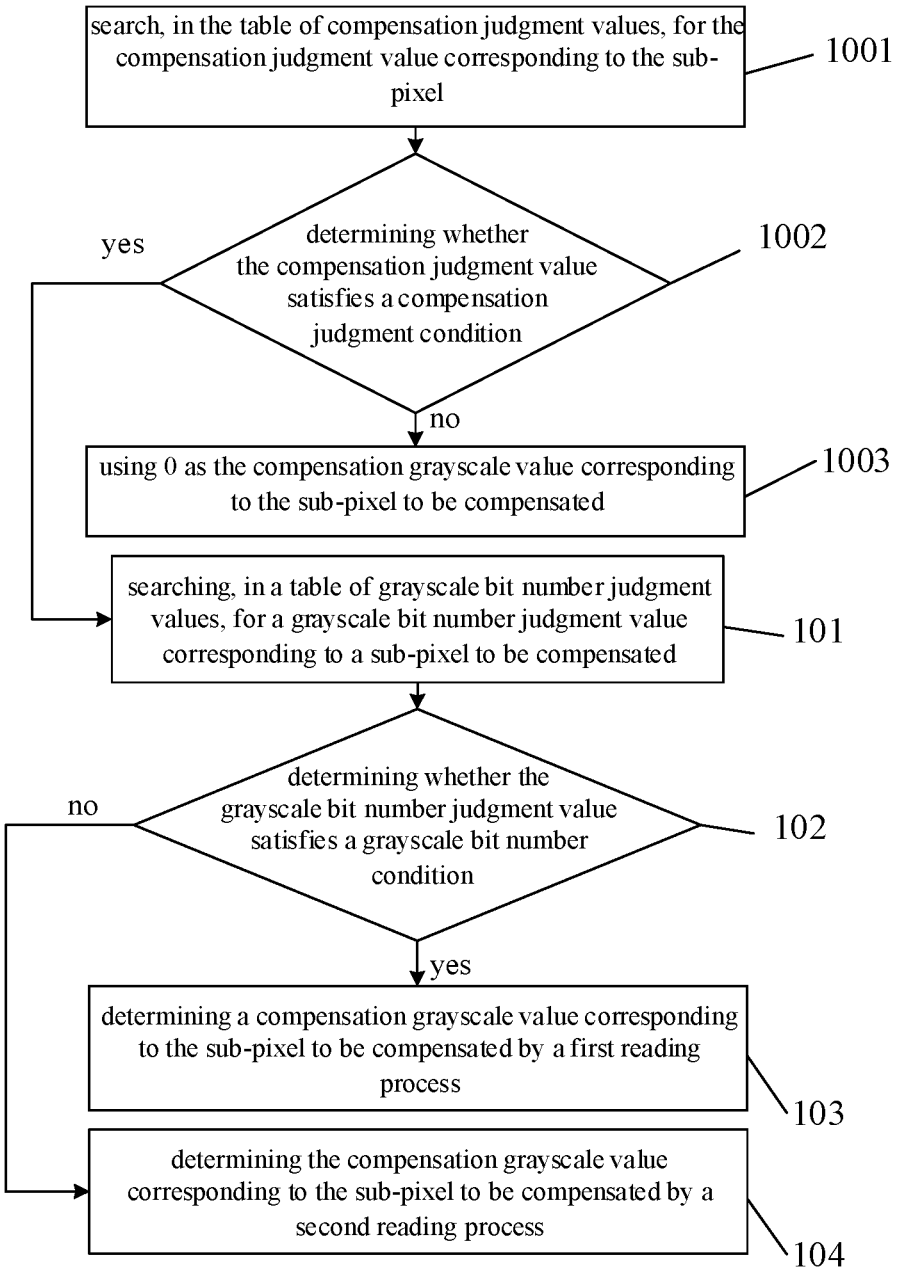
FIG. 2 is a schematic flowchart of another method for determining a compensation grayscale value of a display panel according to an embodiment of the present disclosure.

FIG. 2 is a schematic flowchart of another method for determining a compensation grayscale value of a display panel according to an embodiment of the present disclosure. In an embodiment, as shown in FIG. 2, prior to the above-mentioned step 101, the method further includes following steps.

At step 1001, a search is performed in a table of compensation judgment values for compensation judgment value corresponding to a sub-pixel to be compensated.

At step 1002, it is determined whether the compensation judgment value satisfies a compensation judgment condition; if the compensation judgment value satisfies the compensation judgment condition, the method proceeds to step 101, at which step a search is performed in a table of grayscale bit number judgment values for a grayscale bit number judgment value corresponding to the sub-pixel to be compensated; and if the compensation judgment value does not satisfy the compensation judgment condition, the method proceeds to step 1003, at which step 0 is used as the compensation grayscale value corresponding to the sub-pixel to be compensated.

Table 3 is a table of compensation grayscale values corresponding to five sub-pixels in another embodiment of the present disclosure. As shown in Table 3, a table of compensation judgment values is added, which corresponds to a compensation judgment value of each sub-pixel. The compensation judgment condition is satisfied when the compensation judgment value is 1, which indicates that the sub-pixel requires for grayscale compensation. The compensation judgment condition is not satisfied when the compensation judgment value is 0, which indicates that the sub-pixel requires for no grayscale compensation or that the compensation grayscale value corresponding to the sub-pixel is 0. In addition, as shown in Table 3, if a sub-pixel corresponds to a compensation judgment value of 0, there is no need to store the grayscale bit number judgment value and the first compensation grayscale value. Taking Table 3 as an example, the table of compensation judgment values, the table of grayscale bit number judgment values, the table of first compensation grayscale values, and the table of second compensation grayscale values are pre-stored in the memory. When the display panel is in an operation, a sub-pixel A1 is taken as the sub-pixel to be compensated. At step 1001, a search is performed in the table of compensation judgment values for the compensation judgment value corresponding to the sub-pixel A1. At step 1002, it is determined that the compensation judgment value is 1, which satisfies the compensation judgment condition, indicating that compensation is required, and then the method proceeds to step 101. At step 101, a search is performed in the table of grayscale bit number judgment values for a grayscale bit number judgment value corresponding to the sub-pixel A1. At step 102, it is determined that the grayscale bit number judgment value is 0, which satisfies the grayscale bit number condition, and the method proceeds to step 103. At step 103, a search is performed in the table of first compensation grayscale values for the first grayscale value position corresponding to the sub-pixel A1, and data at the first grayscale value position is 1001, then 1001 is used as the compensation grayscale value corresponding to the sub-pixel A1 for use in performing grayscale compensation on the sub-pixel A1. Then, a sub-pixel A2 is taken as a sub-pixel to be compensated. At step 1001, a search is performed in the table of compensation judgment values for a compensation judgment value corresponding to the sub-pixel A2. Then at step 1002, it is determined that the compensation judgment value is 1, which satisfies the compensation judgment condition, indicating that compensation is required, and then the method proceeds to step 101. At step 101, a search is performed in the table of grayscale bit number judgment values for the grayscale bit number judgment value corresponding to the sub-pixel A2. At step 102, it is determined that the grayscale bit number judgment value is 1, which does not satisfy the grayscale bit number condition, and the method proceeds to step 104. At step 104, a search is performed in the table of first compensation grayscale values for the first grayscale value position corresponding to the sub-pixel A2, and a search is performed in the table of second compensation grayscale values for the second grayscale value position corresponding to the sub-pixel A2. Data at the first grayscale value position is 1110 and data at the second grayscale value position is 01, and then 1110 is used as the highest 4 bits and 01 is used as the lowest 2 bits, so as to obtain 111001 as the compensation grayscale value corresponding to the sub-pixel A2. Then, a sub-pixel A3 is taken as a sub-pixel to be compensated. At step 1001, a search is performed in the table of compensation judgment values for a compensation judgment value corresponding to the sub-pixel A3. Then at step 1002, it is determined that the compensation judgment value is 0, which does not satisfy the compensation judgment condition, indicating that no compensation is required, and then the method proceeds to step 103. At step 103, 0 is used as the compensation grayscale value corresponding to the sub-pixel A3. By this analogy, a compensation grayscale value corresponding to each sub-pixel is determined, and grayscale compensation is performed in accordance with the respective compensation grayscale value. It can be seen by comparing Table 1 with Table 3 that data on the compensation grayscale value corresponding to each sub-pixel occupies a space of 8 bits in the related art, while according to the embodiments of the present disclosure, the data on the compensation grayscale value is stored based on classification of the number of bits of the compensation grayscale value. For example, a sub-pixel corresponding to a decimal compensation grayscale value having an absolute value not greater than 7 and not equal to 0 requires only a space of 6 bits, including 1 bit occupied by the compensation judgment value, 1 bit occupied by the grayscale bit number judgment value and 4 bits occupied by the first compensation grayscale value. A sub-pixel corresponding to a decimal compensation grayscale value having an absolute value greater than 7 requires only a space of 8 bits, including 1 bit occupied by the compensation judgment value, 1 bit occupied by the grayscale bit number judgment value, 4 bits occupied by the first compensation grayscale value and 2 bits occupied by the second compensation grayscale value. A sub-pixel corresponding to a decimal compensation grayscale value having an absolute equal to 0 requires only a space of 1 bit occupied by the compensation judgment value. Compared with the related art, in this embodiment of the present disclosure, redundant data can be reduced by means of classification storage, and space for storing data related to the compensation grayscale value can be reduced. It can be seen by comparing Table 2 with Table 3 that, with the method for determining the compensation grayscale value of the display panel as shown in Table 3, there is no need to store a first compensation grayscale value and a grayscale bit number judgment value corresponding to a sub-pixel that does not need to be compensated with a grayscale value, thereby reducing space for storing data corresponding to a sub-pixel for which no grayscale value compensation is required. In the actual grayscale compensation process of the display panel, there are a lot of sub-pixels that require for no grayscale value compensation. Therefore, with the method for determining the compensation grayscale value of the display panel corresponding to Table 3, the space for storing data related to the compensation grayscale value can be further reduced.

TABLE 3

| | Sub-pixel A1 | Sub-pixel A2 | Sub-pixel A3 | Sub-pixel A4 | Sub-pixel A5 |
|---|---|---|---|---|---|
| Decimal compensation grayscale value | 1 | 25 | 0 | −25 | −1 |
| Binary compensation grayscale value | 1001 | 111001 | | 011001 | 0001 |
| Table of compensation judgment values | 1 | 1 | 0 | 1 | 1 |
| Table of grayscale bit number judgment values | 0 | 1 | | 1 | 0 |
| Table of first compensation grayscale values | 1001 | 1110 | | 0110 | 0001 |
| Table of second compensation grayscale values | | 01 | | 01 | |

In an example, the display panel has a resolution of 2160*720 (2160*720*3=4665600 sub-pixels). For this display panel, there are 3652795 sub-pixels each corresponding to a decimal compensation grayscale value having an absolute value smaller than or equal to 7 and not equal to 0, and there are 511 sub-pixels each corresponding to a decimal compensation grayscale value having an absolute value greater than 7. In this case, in the related art, i.e., with the method for determining the compensation grayscale value of the display panel corresponding to Table 1, a space of 37324800 (37324800=2160*720*3*8) bits is required. However, with the method for determining the compensation grayscale value of the display panel in this embodiments of the present disclosure corresponding to Table 3, only a space of 22930597 (22930597=3652284*6+511*8+1012805*1) bits is required. It can be seen that this embodiment of the present disclosure saves ⅗ storage space compared with the related art.

In an example, the data at the first grayscale value position includes sign bit-data and value bit-data. The sign-bit data is used to indicate whether the compensation grayscale value is positive or negative, and the value-bit data is used to represent a numerical value or a partial numerical value of the compensation grayscale value.

In an example, the number of bits of the data at the first grayscale value position is greater than the number of bits of the data at the second grayscale value position.

In an example, the number of bits of the data at the first grayscale value position is 4, and the number of bits of the data at the second grayscale value position is 2.

The abovementioned step 104, in which the compensation grayscale value corresponding to the sub-pixel to be compensated is determined in accordance with the data at the first grayscale value position and the data at the second grayscale value position, includes: obtaining data on the compensation grayscale value corresponding to the sub-pixel to be compensated. The data at the first grayscale value position is highest 4 bits of the data on the compensation grayscale value, and the data at the second grayscale value position is lowest 2 bits of the data on the compensation grayscale value.

For example, for the sub-pixel A2, the data at the first compensation grayscale value position is 1110, and the data at the second compensation grayscale value position is 01. Then, 1110 is used as the highest 4 bits and 01 is used as the lowest 2 bits, so as to obtain 111001 as the compensation grayscale value corresponding to the sub-pixel A2. Herein, the highest bit is a sign bit, where 1 indicates positive and 0 indicates negative. The remaining data 11001 is converted into a decimal form to be 25. Therefore, the compensation grayscale value corresponding to the sub-pixel A2 is positive 25.

Figure 3:
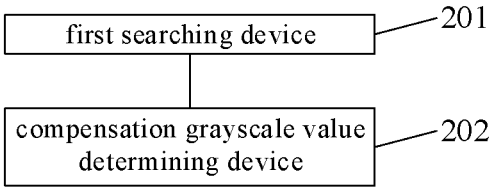
FIG. 3 is a structural block diagram of a device for determining a compensation grayscale value of a display panel according to an embodiment of the present disclosure.

FIG. 3 is a structural block diagram of a device for determining a compensation grayscale value of a display panel according to an embodiment of the present disclosure. As shown in FIG. 3, an embodiment of the present disclosure further provides a device for determining a compensation grayscale value of a display panel. The device for determining the compensation grayscale value of the display panel includes: a first search device 201 configured to search, in a table of grayscale bit number judgment values, for a grayscale bit number judgment value corresponding to a sub-pixel to be compensated; and a compensation grayscale value determining device 202 configured to determine a compensation grayscale value corresponding to the sub-pixel to be compensated by a first reading process if the grayscale bit number judgment value satisfies a grayscale bit number condition, and to determine a compensation grayscale value corresponding to the sub-pixel to be compensated by a second reading process if the grayscale bit number judgment value does not satisfy the grayscale bit number condition. The first reading process includes: searching, in the table of first compensation grayscale values, for a first grayscale value position corresponding to the sub-pixel to be compensated, and then determining the compensation grayscale value corresponding to the sub-pixel to be compensated in accordance with data at the first grayscale value position. The second reading process includes: searching, in the table of first compensation grayscale values, for the first grayscale value position corresponding to the sub-pixel to be compensated, and searching, in a table of second compensation grayscale values, for a second grayscale value position corresponding to the sub-pixel to be compensated, and determining the compensation grayscale value corresponding to the sub-pixel to be compensated in accordance with the data at the first grayscale value position and data at the second grayscale value position.

The device for determining the compensation grayscale value of the display panel can adopt the method for determining the compensation grayscale value of the display panel in the above embodiments, and working processes and working principles thereof are the same as those in the above embodiments, and will not be further described herein.

In an embodiment, the device for determining the compensation grayscale value of the display panel further includes: a second searching device configured to search, in a table of compensation judgment values, for a compensation judgment value corresponding to the sub-pixel to be compensated, and to control the first searching device to search, in the table of grayscale bit number judgment values, for the grayscale bit number judgment value corresponding to the sub-pixel to be compensated if the compensation judgment value satisfies a compensation judgment condition, and to control the compensation grayscale value determining device to use 0 as the compensation grayscale value corresponding to the sub-pixel to be compensated if the compensation judgment value does not satisfy the compensation judgment condition.

In an example, the data at the first grayscale value position includes sign-bit data and value-bit data.

In an example, a number of bits of the data at the first grayscale value position is greater than a number of bits of the data at the second grayscale value position.

In an example, the number of bits of the data at the first grayscale value position is 4, and the number of bits of the data at the second grayscale value position is 2.

The process of determining the compensation grayscale value corresponding to the sub-pixel to be compensated in accordance with the data at the first grayscale value position and the data at the second grayscale value position includes: obtaining data on the compensation grayscale value corresponding to the sub-pixel to be compensated. The data at the first grayscale value position is highest 4 bits of the data on the compensation grayscale value, and the data at the second grayscale value position is lowest 2 bits of the data on the compensation grayscale value.

Figure 4:
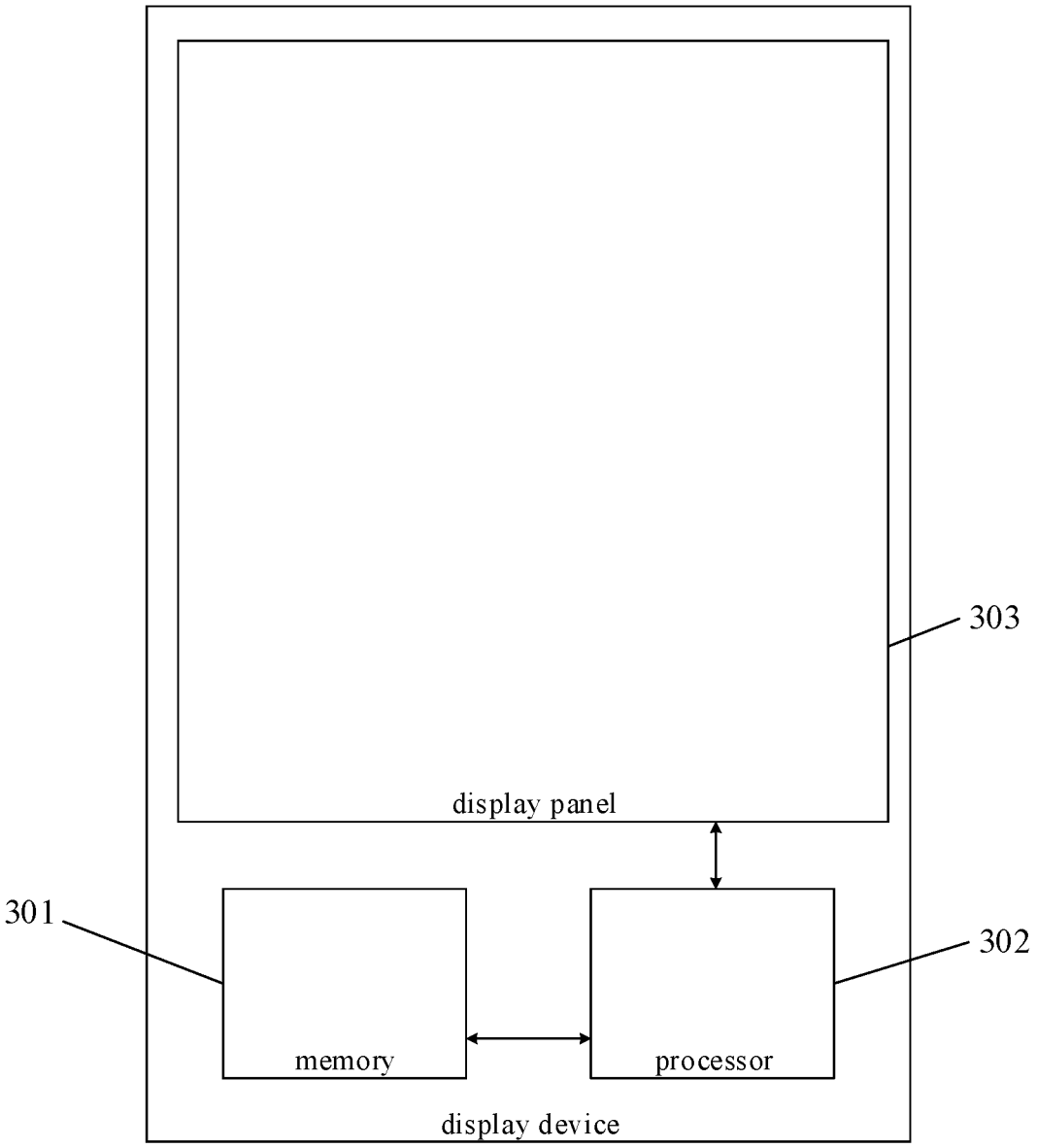
FIG. 4 is a structural block diagram of a display device according to an embodiment of the present disclosure.

FIG. 4 is a structural block diagram of a display device according to an embodiment of the present disclosure. As shown in FIG. 4, an embodiment of the present disclosure further provides a display device. The display device includes a memory 301 and a processor 302. The memory 301 is configured to store information including program instructions. The processor 302 is configured to control execution of the program instructions. The program instructions are loaded and executed by the processor to implement steps of the method for determining the compensation grayscale value of the display panel according to the above embodiments. The display device further includes a display panel 303. After the processor 302 determines the compensation grayscale value of the display panel, the display panel 303 is driven in accordance with the compensation grayscale value.

The processor 302 may be a central processing device (CPU), and may also be another general processor, a digital signal processor (DSP), an application specific integrated circuit (ASIC), a field-programmable gate array (FPGA), or other programmable logic device, a discrete gate or a transistor logic device, a discrete hardware component, etc. The general processor may be a microprocessor or any conventional processor or the like.

In the embodiments provided by the present disclosure, it should be understood that the disclosed system, device, and method may be implemented in other manners. For example, the device embodiments described above are merely illustrative. For example, the classification of the devices are merely based on the logic function. In actual implementation, there may be classification manners. For example, multiple devices or components may be combined or integrated into another system, or some features may be ignored or not executed. In addition, coupling or direct coupling or communication connection shown or described above may be indirect coupling or communication connection through some interfaces, device or device, and may be in an electrical, mechanical or other form.

The devices illustrated as separate components may or may not be physically separated, and the components shown as devices may or may not be physical devices, i.e., they may be located in one place, or may be distributed to at least two network devices. Some or all of the modules may be selected in accordance with actual needs to achieve the purpose of the solution of the embodiment.

In addition, each functional device in each embodiment of the present disclosure may be integrated into one processing device, or each device may physically separately exist, or two or more devices may be integrated into one device. The integrated device described above can be implemented in a form of hardware or in a form of hardware plus software functional devices.

The integrated device implemented in the form of a software functional device described above may be stored in a computer readable storage medium. The software functional device described above is stored in a storage medium and includes instructions for causing a computer device (which may be a personal computer, a server, a network device, or the like) or a processor to perform some steps of the method in each embodiment of the present disclosure. The storage medium can be any medium that can store program codes, such as a U disk, a mobile hard disk, a read-only memory (ROM), a random access memory (RAM), a magnetic disk, an optical disk, etc.

What is claimed is:

1. A method for determining a compensation grayscale value of a display panel, comprising:

searching, in a table of grayscale bit number judgment values, for a grayscale bit number judgment value corresponding to a sub-pixel to be compensated, wherein the grayscale bit number judgment value is used to indicate whether the binary grayscale bit number corresponding to the sub-pixel is greater than a value;

determining a compensation grayscale value corresponding to the sub-pixel to be compensated by a first reading process if the grayscale bit number judgment value satisfies a grayscale bit number condition; and determining the compensation grayscale value corresponding to the sub-pixel to be compensated by a second reading process if the grayscale bit number judgment value does not satisfy the grayscale bit number condition, wherein the first reading process comprises:

searching, in a table of first compensation grayscale values, for a first grayscale value position corresponding to the sub-pixel to be compensated, and determining the compensation grayscale value corresponding to the sub-pixel to be compensated in accordance with data at the first grayscale value position, and wherein the second reading process comprises:

searching, in the table of first compensation grayscale values, for the first grayscale value position corresponding to the sub-pixel to be compensated; searching, in a table of second compensation grayscale values, for a second grayscale value position corresponding to the sub-pixel to be compensated; and determining the compensation grayscale value corresponding to the sub-pixel to be compensated in accordance with the data at the first grayscale value position and data at the second grayscale value position.

2. The method for determining the compensation grayscale value of the display panel according to claim 1, further comprising, prior to searching, in the table of grayscale bit number judgment values, for the grayscale bit number judgment value corresponding to the sub-pixel to be compensated:

searching, in a table of compensation judgment values, for a compensation judgment value corresponding to the sub-pixel to be compensated, wherein said searching, in the table of grayscale bit number judgment values, for the grayscale bit number judgment value corresponding to the sub-pixel to be compensated is performed if the compensation judgment value satisfies a compensation judgment condition; and 0 is used as the compensation grayscale value corresponding to the sub-pixel to be compensated if the compensation judgment value does not satisfy the compensation judgment condition.

3. The method for determining the compensation grayscale value of the display panel according to claim 1, wherein the data at the first grayscale value position comprises sign-bit data and value-bit data.

4. The method for determining the compensation grayscale value of the display panel according to claim 1, wherein a number of bits of the data at the first grayscale value position is greater than a number of bits of the data at the second grayscale value position.

5. A method for determining a compensation grayscale value of a display panel, comprising:

searching, in a table of grayscale bit number judgment values, for a grayscale bit number judgment value corresponding to a sub-pixel to be compensated;

determining a compensation grayscale value corresponding to the sub-pixel to be compensated by a first reading process if the grayscale bit number judgment value satisfies a grayscale bit number condition; and determining the compensation grayscale value corresponding to the sub-pixel to be compensated by a second reading process if the grayscale bit number judgment value does not satisfy the grayscale bit number condition, wherein the first reading process comprises:

searching, in a table of first compensation grayscale values, for a first grayscale value position corresponding to the sub-pixel to be compensated, and determining the compensation grayscale value corresponding to the sub-pixel to be compensated in accordance with data at the first grayscale value position, and wherein the second reading process comprises:

searching, in the table of first compensation grayscale values, for the first grayscale value position corresponding to the sub-pixel to be compensated; searching, in a table of second compensation grayscale values, for a second grayscale value position corresponding to the sub-pixel to be compensated; and determining the compensation grayscale value corresponding to the sub-pixel to be compensated in accordance with the data at the first grayscale value position and data at the second grayscale value position;

wherein the number of bits of the data at the first grayscale value position is 4, and the number of bits of the data at the second grayscale value position is 2, and said determining the compensation grayscale value corresponding to the sub-pixel to be compensated in accordance with data at the first grayscale value position and data at the second grayscale value position comprises:

obtaining data on the compensation grayscale value corresponding to the sub-pixel to be compensated, the data at the first grayscale value position being highest 4bits of the data on the compensation grayscale value, and the data at the second grayscale value position being lowest 2bits of the data on the compensation grayscale value.

6. A display device, comprising:

a memory configured to store information comprising program instructions; and a processor configured to control execution of the program instructions, wherein the program instructions are loaded and executed by the processor to implement the method for determining the compensation grayscale value of the display panel, comprising:

searching, in a table of grayscale bit number judgment values, for a grayscale bit number judgment value corresponding to a sub-pixel to be compensated, wherein the grayscale bit number judgment value is used to indicate whether the binary grayscale bit number corresponding to the sub-pixel is greater than a value;

determining a compensation grayscale value corresponding to the sub-pixel to be compensated by a first reading process if the grayscale bit number judgment value satisfies a grayscale bit number condition; and determining the compensation grayscale value corresponding to the sub-pixel to be compensated by a second reading process if the grayscale bit number judgment value does not satisfy the grayscale bit number condition, wherein the first reading process comprises:

searching, in a table of first compensation grayscale values, for a first grayscale value position corresponding to the sub-pixel to be compensated, and determining the compensation grayscale value corresponding to the sub-pixel to be compensated in accordance with data at the first grayscale value position, and wherein the second reading process comprises:

searching, in the table of first compensation grayscale values, for the first grayscale value position corresponding to the sub-pixel to be compensated; searching, in a table of second compensation grayscale values, for a second grayscale value position corresponding to the sub-pixel to be compensated; and determining the compensation grayscale value corresponding to the sub-pixel to be compensated in accordance with the data at the first grayscale value position and data at the second grayscale value position.

7. The display device according to claim 6, wherein the method for determining the compensation grayscale value of the display panel further comprises: prior to searching, in the table of grayscale bit number judgment values, for the grayscale bit number judgment value corresponding to the sub-pixel to be compensated:

searching, in a table of compensation judgment values, for a compensation judgment value corresponding to the sub-pixel to be compensated, wherein said searching, in the table of grayscale bit number judgment values, for the grayscale bit number judgment value corresponding to the sub-pixel to be compensated is performed if the compensation judgment value satisfies a compensation judgment condition; and 0 is used as the compensation grayscale value corresponding to the sub-pixel to be compensated if the compensation judgment value does not satisfy the compensation judgment condition.

8. The display device according to claim 6, wherein the data at the first grayscale value position comprises sign-bit data and value-bit data.

9. The display device according to claim 6, wherein a number of bits of the data at the first grayscale value position is greater than a number of bits of the data at the second grayscale value position.

10. The display device according to claim 9, wherein the number of bits of the data at the first grayscale value position is 4, and the number of bits of the data at the second grayscale value position is 2, and said determining the compensation grayscale value corresponding to the sub-pixel to be compensated in accordance with data at the first grayscale value position and data at the second grayscale value position comprises:

obtaining data on the compensation grayscale value corresponding to the sub-pixel to be compensated, wherein the data at the first grayscale value position being highest 4bits of the data on the compensation grayscale value, and the data at the second grayscale value position being lowest 2bits of the data on the compensation grayscale value.

* * * * *